US005101871A

United States Patent [19]

Susumu

[11] Patent Number: 5,101,871

[45] Date of Patent: Apr. 7, 1992

[54] SEALING MEMBER ON A TONER CARTRIDGE

[75] Inventor: Komaki Susumu, Nishinomiya, Japan

[73] Assignee: Mita Industrial Co., Ltd., Hyogo, Japan

[21] Appl. No.: 586,006

[22] Filed: Sep. 21, 1990

[30] Foreign Application Priority Data

Sep. 22, 1989 [JP] Japan ..... 1-244969

[51] Int. Cl.[5] ..... B65D 43/02; G03G 15/06

[52] U.S. Cl. ..... 141/364; 141/354; 141/363; 229/123.1; 355/260

[58] Field of Search ..... 355/215, 245, 260; 206/631, 633; 222/DIG. 1, 541, 544; 229/123.1; 141/354, 363, 364

[56] References Cited

U.S. PATENT DOCUMENTS

| | | | |
|---|---|---|---|
| 4,650,070 | 3/1987 | Oka et al. | 206/633 X |
| 4,799,608 | 1/1989 | Oka | 222/541 X |
| 4,827,307 | 5/1989 | Zoltner | 206/633 X |
| 4,834,246 | 5/1989 | Inoue et al. | 206/631 |

FOREIGN PATENT DOCUMENTS

| | | | |
|---|---|---|---|
| 0041068 | 3/1985 | Japan | 355/260 |
| 0243978 | 10/1988 | Japan . | |
| 0081977 | 3/1989 | Japan | 355/260 |
| 0161274 | 6/1989 | Japan | 355/260 |
| 0280781 | 11/1989 | Japan | 355/260 |

*Primary Examiner*—A. T. Grimley
*Assistant Examiner*—J. E. Barlow, Jr.
*Attorney, Agent, or Firm*—H. Jay Spiegel

[57] ABSTRACT

Disclosed is a toner cartridge in which not only a first zone is provided for containing a toner therein but also a second zone is formed and a first opening and a second opening are formed adjacent to each other in these zones, respectively, one end of a sealing member being located on the edge, on the side of the second opening, of the first opening while the other end of the sealing member is secured to the confronting edge of the second opening, and the sealing member is peeled in the state where the sealing member is stuffed into the second zone through the second opening. In this toner cartridge, the attachment size of the cartridge is shortened and the attachment operation and the operation of peeling the sealing member are simplified. Furthermore, the carriage which finishes replenishment of the toner is drawn out from the toner supply zone of the developing device by a one-touch operation without touching the sealing member by hands, and even if the toner adheres to the sealing member, an advantage is attained, in that hands of an operator and surroundings are not contaminated with the toner.

6 Claims, 6 Drawing Sheets

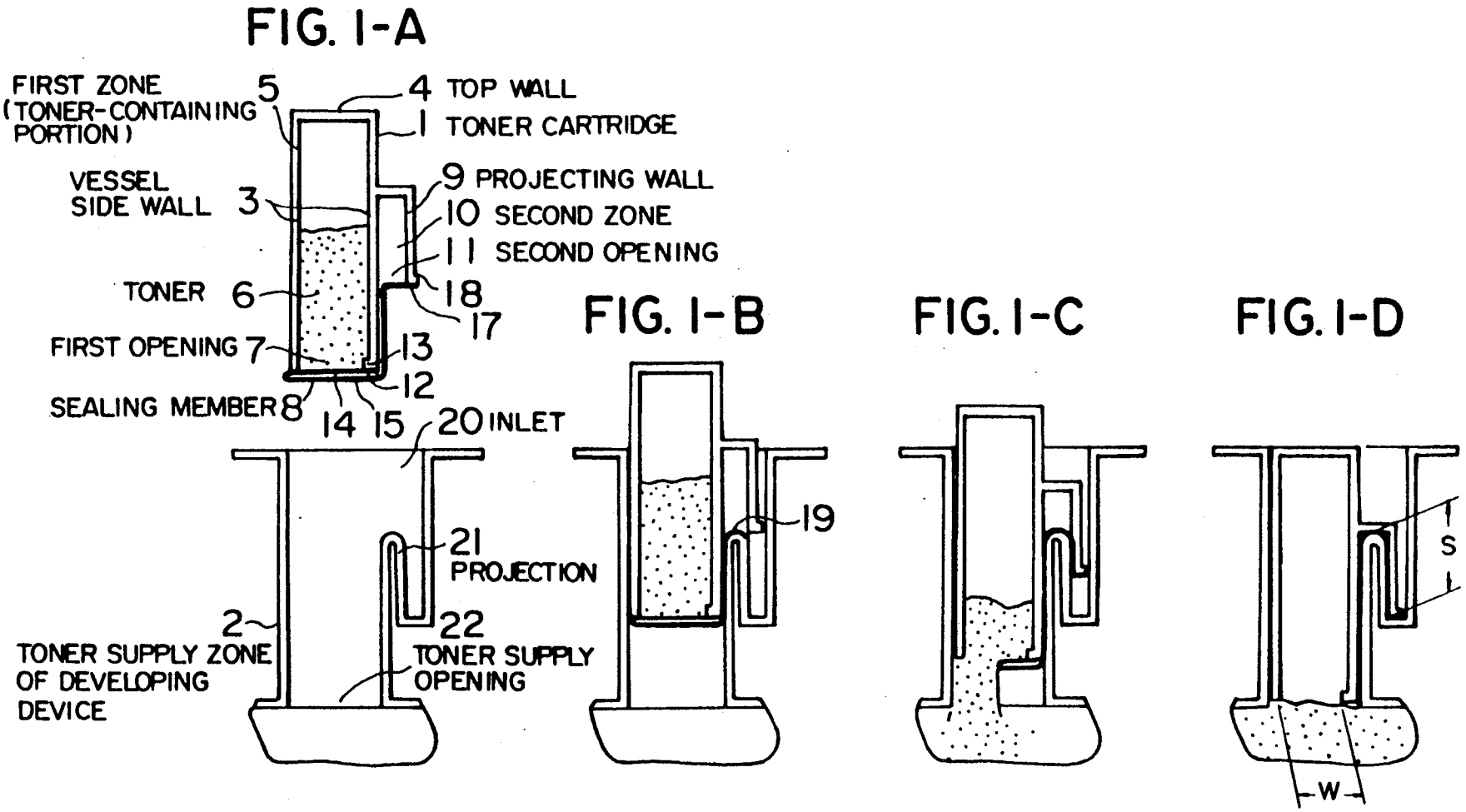
FIG. 1-A
FIG. 1-B
FIG. 1-C
FIG. 1-D
FIRST ZONE (TONER-CONTAINING PORTION)
VESSEL SIDE WALL
TONER
FIRST OPENING
SEALING MEMBER
TONER SUPPLY ZONE OF DEVELOPING DEVICE
TOP WALL
TONER CARTRIDGE
PROJECTING WALL
SECOND ZONE
SECOND OPENING
INLET
PROJECTION
TONER SUPPLY OPENING
1
2
3
4
5
6
7
8
9
10
11
12
13
14
15
17
18
19
20
21
22
S
W FIG. 2-B
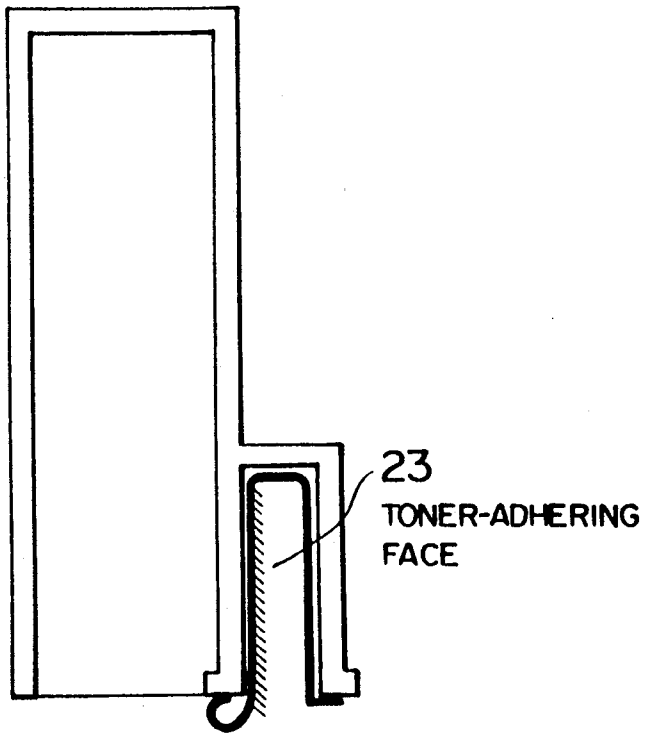
FIG. 2-A
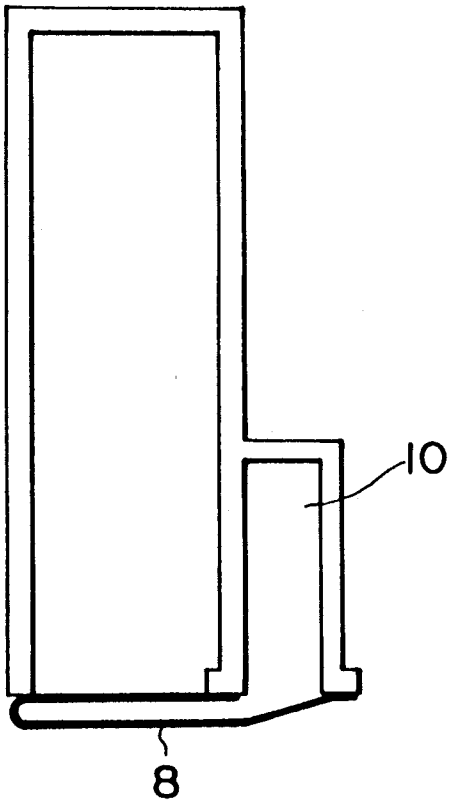

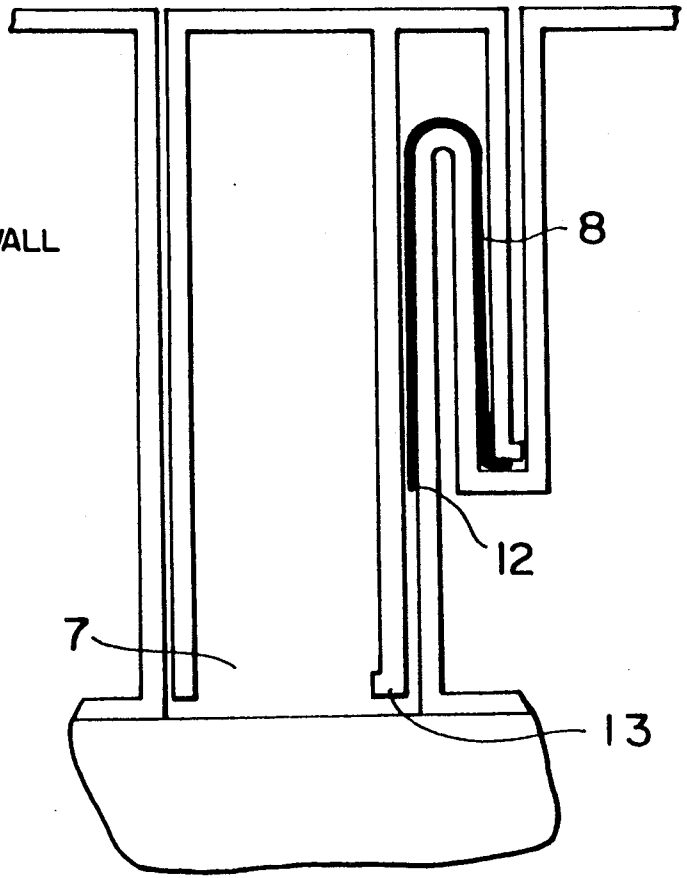
FIG. 3-B
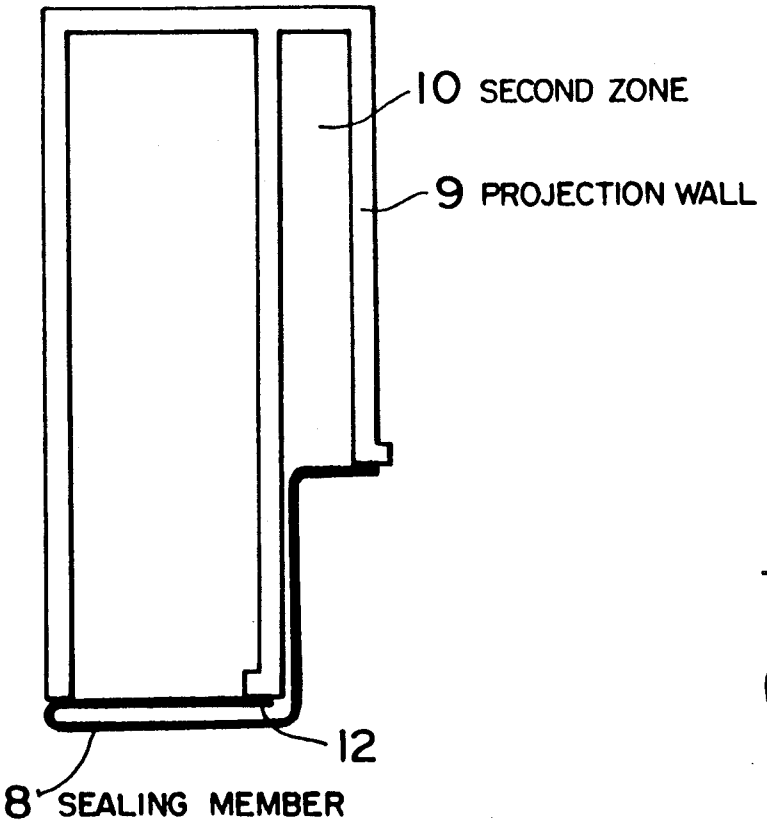
FIG. 3-A

FIG. 5-A
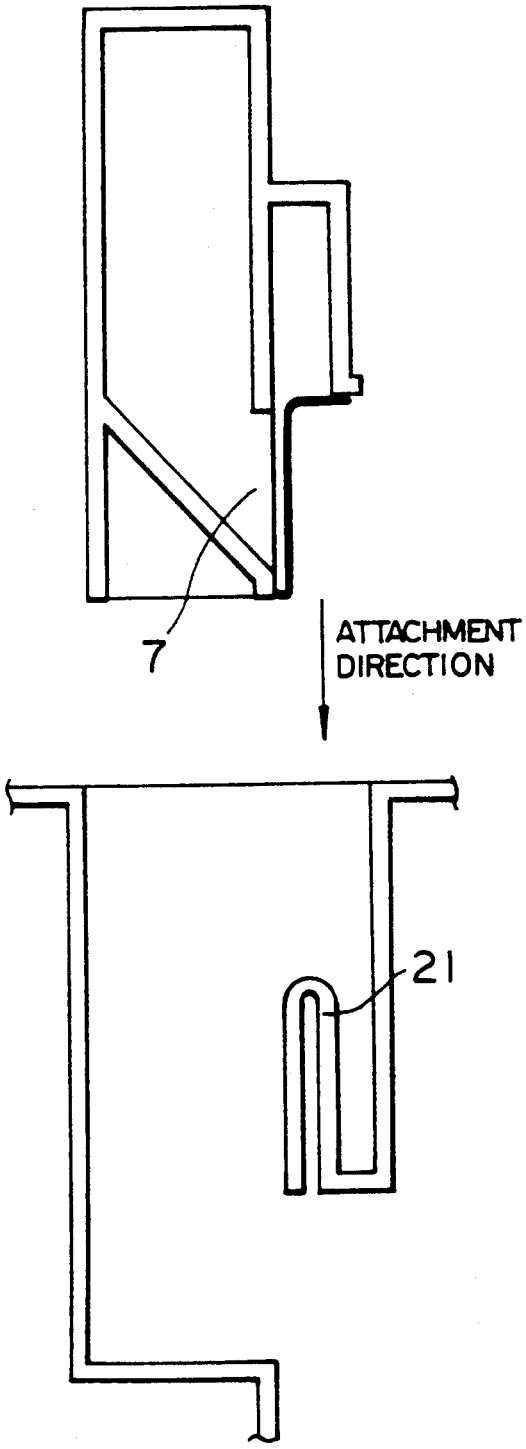
FIG. 5-B
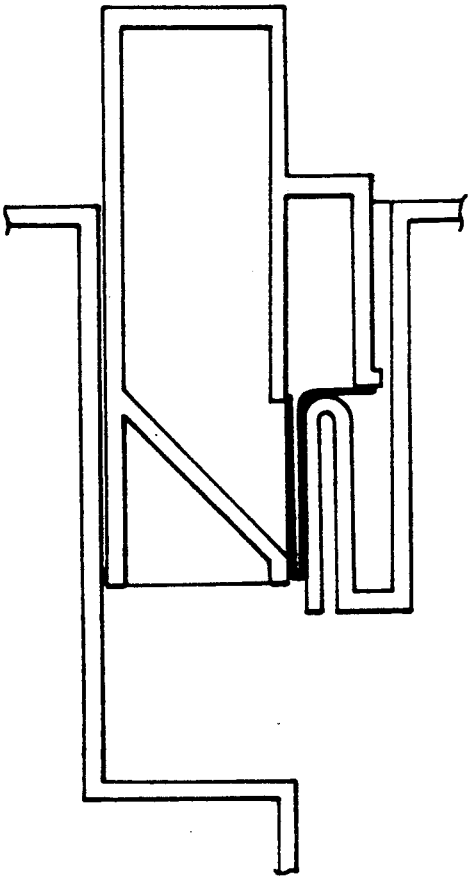

SEALING MEMBER ON A TONER CARTRIDGE

BACKGROUND OF THE INVENTION (1) Field of the Invention

The present invention relates to a toner cartridge. More particularly, the present invention relates to an improvement of a cartridge of the type where sealing of the cartridge is broken synchronously with attachment of the cartridge for replenishment of a toner.

(2) Description of the Related Art

For replenishment of a developing toner in an electrophotographic copying machine or the like, a toner cartridge is used, which comprises a vessel for containing a toner therein, a toner supply opening formed in the vessel and a sealing member for covering the supply opening, and this cartridge of the type where a sealing member is peeled simultaneously or synchronously with attachment of the cartridge has already been known. For example, Japanese Unexamined Utility Model Publication No. 55-99546 and Japanese Unexamined Patent Publication No. 55-90979 disclose a toner cartridge in which an opening is formed on the bottom face of a toner vessel, this opening is covered from one end toward the other end with a covering member, the sealing member is folded back on the other end, a claw member is formed in the end portion of the sealing member, and when the cartridge is attached to a copying machine, this claw member falls in engagement with a projection formed on the copying machine to peel the sealing member.

In a toner cartridge of this type, however, since the sealing member is folded back in the toner supply opening and the sealing member is peeled by gripping the free end of the sealing member and pulling this free end, a length two times the width of the opening is necessary as the stroke for peeling the sealing member, and therefore, the cartridge is defective in that the size of the cartridge-attaching portion becomes large. Furthermore, when the cartridge is attached, the moving distance of the cartridge required for the complete peeling of the sealing member from the start of the peeling becomes long, and therefore, scattering of the toner is readily caused. Moreover, the cartridge is inclined because of peeling, and the attachment becomes difficult.

Still further, while the toner cartridge is stored or handled, the claw member is secured to the cartridge, and when the cartridge is attached, the claw member should be dismounted from the cartridge, and it is difficult to secure such a dismountable claw member.

Still in addition, when the toner cartridge is drawn out from the toner supply zone, the toner-adhering surface of the sealing member is located on the outer side, and hence, the hands of an operator are contaminated with the adhering toner or there is a risk of contamination of surroundings with the toner. A particular cleaning member should be disposed to prevent this contamination.

SUMMARY OF THE INVENTION

It is therefore a primary object of the present invention to overcome the above-mentioned defects of the conventional toner cartridge and provide a toner cartridge having a simple structure, in which the attaching operation and the operation of peeling the sealing member can be easily performed.

Another object of the present invention is to provide a toner cartridge in which the stroke of attaching the cartridge to the toner supply zone and the stroke of peeling the sealing member are shorter than in the conventional cartridges, and scattering of the toner is not caused at the time of peeling the sealing member.

Still another object of the present invention is to provide a toner cartridge which can be drawn out from the toner supply zone without exposure of the peeled sealing member to the outer side.

A further object of the present invention is to provide a toner cartridge in which final peeling of the sealing member can be confirmed and supply of the toner is possible in the state where the cartridge is properly and tightly attached to the toner supply zone of the machine proper.

More specifically, in accordance with the present invention, there is provided a toner cartridge to be attached to a toner supply zone of a developing device to replenish a toner to the developing device, which comprises a vessel for containing the toner therein, a toner supply opening formed in the vessel and a sealing member covering the toner supply opening, wherein the vessel comprised a first zone filled with the toner and a second zone not filled with the toner, a first opening from which the toner flows out at the time of attachment of the cartridge is formed in the first zone, a second opening adjoining directly or with a certain space to the first opening is formed in the second zone, the sealing member is arranged so that one end portion of the sealing member is located on the edge, on the side of the second opening, of the first opening, a part of the sealing member is peelably sealed to the whole peripheral edge of the first opening, the remaining part of the sealing member is folded back on the other edge of the first opening to stride over the first opening and second opening and the other end of the sealing member is secured to the confronting edge of the second opening, and synchronously with the attachment of the cartridge, at least a part of the sealing member being peeled is stuffed and contained in the second zone.

According to a preferred embodiment of the present invention, the toner supply zone of the developing device comprises a projection to be inserted in the second zone, and when the toner cartridge is attached to the toner supply zone, the sealing member is stuffed in the second zone in a U-figured shape by the projection to peel the sealing member from the first opening.

In order to simplify the structure, in general, the first opening and second opening are formed on the plane traversing the direction of the attachment of the cartridge. However, if the first opening is formed on the plane parallel to the direction of the attachment of the cartridge and the second opening is formed on the plane traversing the direction of the attachment of the cartridge, the attachment direction becomes the same as the direction of peeling the sealing (both the planes are parallel to each other) and the peeling is facilitated, and functions described hereinafter can be exerted.

In the present invention, the size of the second zone in the attachment direction may be the same as or slightly larger than the width of the first opening.

BRIEF DESCRIPTION OF THE DRAWINGS

FIGS. 1-A through 1-D are sectional views illustrating a first embodiment of the toner cartridge of the present invention.

FIGS. 2-A and 2-B are sectional views illustrating a second embodiment of the toner cartridge of the present invention.

FIGS. 3-A and 3-B are sectional views illustrating a third embodiment of the toner cartridge of the present invention.

FIGS. 5-A and 5-B are sectional views illustrating a fourth embodiment of the toner cartridge of the present invention.

DETAILED DESCRIPTION OF THE PREFERRED EMBODIMENTS

Figure 4:
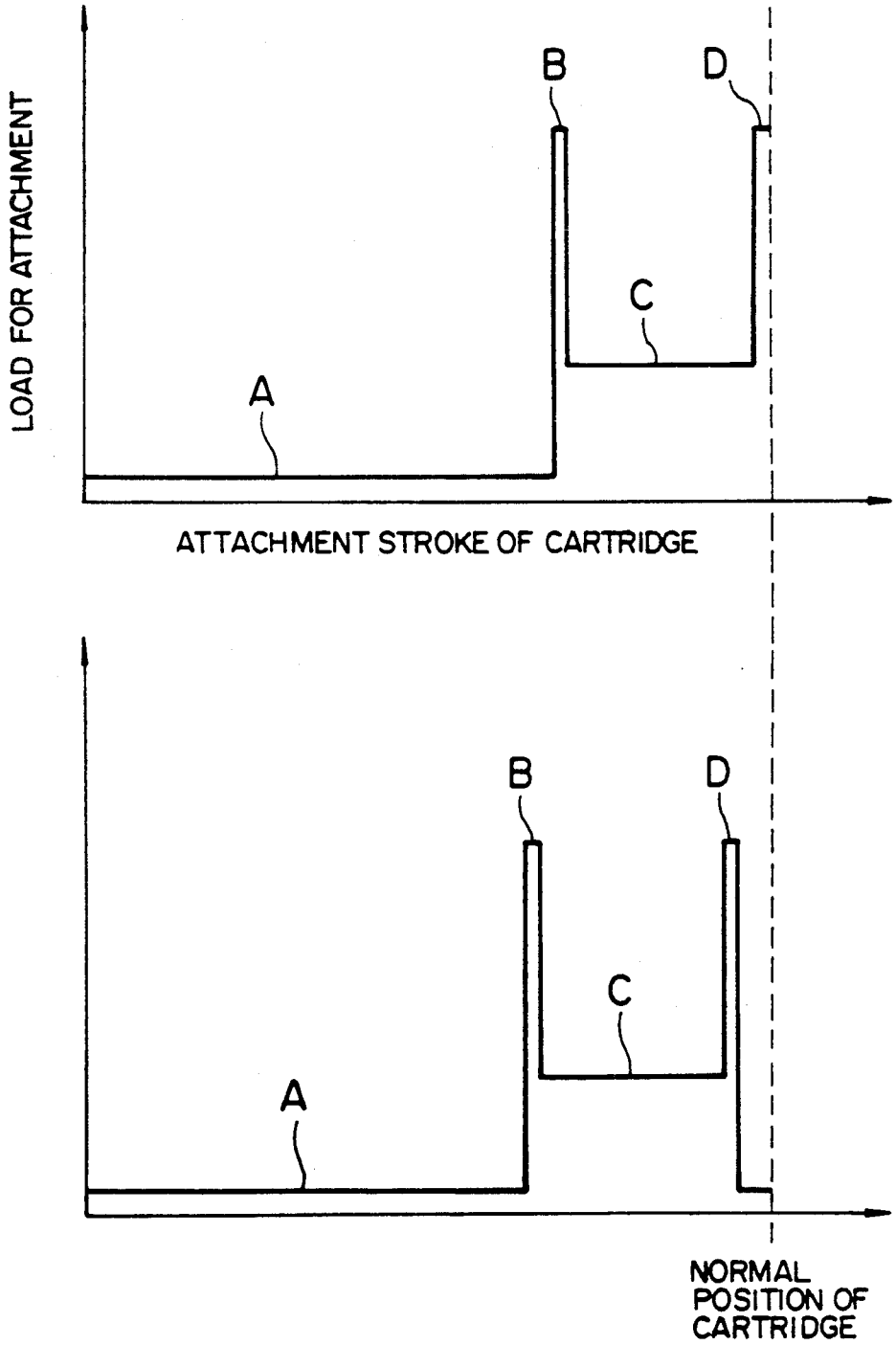
FIG. 4 is a diagram illustrating the relation between the attachment stroke of the toner cartridge of the present invention and the attachment load.

The toner cartridge of the present invention is in agreement with the known cartridge in the structure having a vessel for containing a toner therein, a toner supply opening formed in the vessel and a sealing member covering the toner supply opening. The first characteristic feature of the toner cartridge of the present invention is that the vessel comprises a first zone filled with the toner and a second zone not filled with the toner, a first opening from which the toner flows out at the time of attachment of the cartridge is formed in the first zone, and a second opening adjoining directly or with a certain space to the first opening is arranged in the second zone.

The second characteristic feature of the toner cartridge is that (1) one end portion of the sealing member is located on the edge, on the side of the second opening, of the first opening, (2) a part of the sealing member is peelably sealed to the whole peripheral edge of the first opening, (3) the remaining part of the sealing member is folded back on the other edge of the first opening to stride over the first opening and second opening, and (4) the other end portion of the sealing member is secured to the confronting edge of the second opening.

The third characteristic feature of the toner cartridge of the present invention is that synchronously with the attachment of the cartridge, at least a part of the sealing member being peeled is stuffed and contained in the second zone.

The first opening and second opening are arranged is as adjoining positional relationship, and one end portion of the sealing member is located on one edge, on the side of the second opening, of the first opening and the other end portion of the sealing member is secured to the confronting edge of the second opening. Furthermore, the sealing member is peeled in the state where the sealing member is stuffed into the second zone through the second opening. Accordingly, the sealing member, which is folded back in the first opening and is present in the double-piled state while it is sealed, is similarly folded back in the first zone and is in the double-piled state while it is opened. Therefore, the stroke of peeling the sealing member is made substantially equal to the width of the first opening, and the attachment size of the cartridge can be shortened, whereby the attachment operation and the operation of peeling the sealing member can be simplified.

Furthermore, according to the present invention, since the peeled sealing member is contained in the second zone, the cartridge which finishes the replenishment of the toner can be drawn out from the toner supply zone of the developing device by a one-touch operation without touching the sealing member by hands, and even if the toner adheres to the sealing member, hands of an operator or the surroundings are not contaminated with the toner.

EXAMPLE

The present invention will now be described in detail with reference to embodiments illustrated in the accompanying drawings.

Referring to FIGS. 1-A through 1-D illustrating the attachment operation of one embodiment of the toner cartridge of the present invention, reference numeral 1 represents a toner cartridge and reference numeral 2 represents a toner supply zone of a developing device. The cartridge 1 has a first zone (toner-containing zone) 5 defined by a vessel side wall 3 and a top wall 4. The first zone 5 is filled with a toner 6. This first zone 5 has a downward first opening 7, and a sealing member represented by reference numeral 8 as a whole is arranged on this first opening 7. A projecting window 9 protruding from the side wall 3 by a certain space is formed on one side of the vessel side wall 3, and a second zone 10 not filled with the toner is formed between this projecting wall 9 and the vessel side wall 3. Also the second zone 10 has a downward second opening 11, and as is apparent from the drawings, the second opening 11 is arranged adjacently to the first opening 7. One end portion 12 of the sealing member 8 is located on the edge 13, on the side of the second opening, of the first opening 7, a part 14 of the sealing member 8 covers the first opening 7 and is sealed to the entire peripheral edge of the first opening 7, and a remaining part 15 of the sealing member 8 is folded back on the other edge 16 of the first opening 7 to stride over the first opening 7 and second opening 11 and the other end portion 17 of the sealing member is secured on the confronting edge 18 of the second opening 11.

The toner supply zone 2 of the developing device has an inlet 20 for guiding the side wall 3 of the cartridge 1, and a projection 21 to be inserted into the second zone 10 of the cartridge 1 is formed in this inlet 20. A toner supply opening 22 for the developing device (not shown) is formed below the inlet 20.

As shown in FIG. 1-A, the cartridge 1 is inserted into the inlet 20 of the toner supply zone 2 in the state where the first opening 7 and second opening 11 are kept downward, whereby the projection 21 is caused to about against the portion 19, covering the second opening 11, of the sealing member (see FIG. 1-B). When the cartridge 1 is further stuffed into the inlet 20, the portion 19 of the sealing member is stuffed in a U-figured shape into the second zone 10, and simultaneously, the first portion 14 of the sealing member 8 is peeled from the first opening 7 and the toner 6 is supplied into the developing device through the first opening 7 and the supply opening 22 (see FIG. 1-C). At the point when the projection 21 is completely inserted in the second zone 10, the sealing member is in the state where the sealing member is completely peeled from the first opening 7 (see FIG. 1-D), and all of the toner in the cartridge is supplied into the toner supply zone. When the cartridge 1 is drawn up from the toner supply zone 2 in this state, both the end portions 12 and 17 of the sealing member 8 are secured in the cartridge 1, and the sealing member 8 is taken out to the outside in the state where at least a part of the sealing member 8 is contained in the second zone 10. When the toner is supplied by using the cartridge of the present invention, any operation to be performed while touching the sealing member 8 by hands is not necessary, and furthermore, as will be readily understood, peeling of the sealing member 8 is performed synchronously with the attachment operation. Moreover, the seal width W of the first opening 7 is substantially equal to the stroke length S of the projection 21, and the size of the attachment portion can be shortened and the operation is facilitated.

In the embodiment shown in FIGS. 1-A through 1-D, a step (space) is formed in the attachment direction between the first opening 7 and the second opening 11. However, the first opening 7 and the second opening 11 can be formed on a common horizontal plane, as shown in FIG. 2-A. In this case, as shown in FIG. 2-B, almost all of the peeled sealing member 8 is contained in the second zone, and the toner-adhering surface 23 of the sealing member is contained in the second zone 10. Accordingly, scattering of the toner to surroundings can be further reduced when the cartridge 1 is taken out.

In the embodiment shown in FIGS. 1-A through 1-D, when the stroke length S of the projection 21 becomes substantially equal to the seal width W, the projection 21 about against the top of the projecting wall 9 to complete the insertion of the cartridge 1. However, there can be adopted a modification in which the length of the projecting wall 9 is increased and the length (height) of the second zone 10 is sufficiently increased, and also one end portion 12 of the sealing member 8 is completely peeled, as shown in FIG. 3-A. In this embodiment, as shown in FIG. 3-B, also one end portion 12 of the sealing member 8 is completely peeled from the edge 13 of the first opening 7 and almost all of the sealing member is contained in the second zone 10.

FIG. 4 is a graph illustrating the relation between the displacement of the attachment stroke of the cartridge, plotted on the abscissa, and the load necessary for the attachment, plotted on the ordinate. In FIG. 4, the upper curve shows the relation observed in the structure shown in FIGS. 1-A through 1-D, and the lower curve shows the relation observed in the structure shown in FIGS. 3-A and 3-B. In these curves, the load A is one generated by the friction between the cartridge 1 and the inlet 20, and the peak load B is the force for peeling the seal portion having a long seal length by the abutment of the projection 21 against the sealing member 8. When peeling of this portion is finished, the seal portion having a short peel length is peeled, and hence, the load C is weakened. Then, the seal portion having a long seal length between one end portion 12 of the sealing member 8 and one edge 13 of the opening is peeled, and therefore, the load is increased again as represented by the peak D. In the embodiment shown in FIGS. 1-A through 1-D, at the position of this peak load D, insertion and peeling of the cartridge are completed. However, in the embodiment shown in FIGS. 3-A and 3-B, it can be confirmed that the load passes through this peak load and the load for the insertion is reduced, and therefore, it can be easily confirmed that complete peeling of the seal and the supply of the toner to the developing device are finished.

In the embodiments illustrated hereinbefore, the first opening 7 and the second opening 11 are arranged in parallel to the plane traversing the attachment direction of the cartridge 1. However, as shown in FIGS. 5-A and 5-B, there can be adopted an embodiment in which the first opening 7 is located on the plane parallel to the attachment direction of the cartridge and the second opening 11 is located on the plane traversing the attachment direction of the cartridge. According to this embodiment, the inserting force by the projection 21 is directly transmitted to the seal portion as a 180° C. peeling force, and therefore, inclination or displacement of the cartridge is not caused at the time of the insertion thereof, and there can be attained an advantage in that the operation can be performed very easily.

The cartridge of the present invention can be prepared by forming an entire vessel or vessel members from a plastic material by known means such as injection molding, extrusion molding, blow molding or compression molding and, if necessary, integrating a plurality of vessel members by such means as ultrasonic welding. Moisture-resistant resins, especially olefin resins such as polyethylene, polypropylene and an ethylene/-propylene copolymers, styrene resins and ABS resins, are preferably used as the plastic material for preventing intrusion of moisture into the toner.

The sealing member, at least the surface thereof on the side of the vessel, should be composed of a heat-sealable material. By the peelable bonding or peelable heat sealing is meant such a bonding state that bonding (heat sealing) is maintained at a level where sealing storage is possible but peeling of bonding or heat sealing by hands is possible, and in general, the seal strength (peel strength) is 100 to 1500 g per 1.5 cm of the width. For example, peelable bonding is not attainable between polyethylene layers or between polypropylene layers. However, peelable sealing can be attained between a polyethylene (polypropylene) layer and a sealing layer of a different resin, for example, polypropylene (polyethylene) or a blend comprising a small amount of a rubber or the like.

Figure 6:
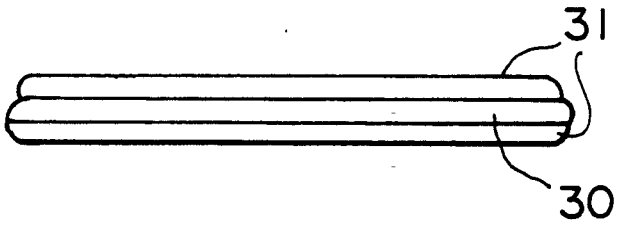
FIG. 6 is a sectional view illustrating one embodiment of the sealing member of the toner cartridge of the present invention.

FIG. 6 illustrates an example of the sectional structure of the sealing member preferably used in the present invention. A peelable heat-sealed layer 31 composed of the above-mentioned blend is formed on both the surfaces of a substrate film 30. Incidentally, sealing of the sealing member 8 and the entire peripheral edge of the first opening 7 and fixation of the sealing member 8 to the confronting edge 18 of the second opening 11 are accomplished by heat sealing. In the former sealing, a 180° peeling force acts and in the latter fixation, only a shear stress acts. Accordingly, there is no risk of breaking of the latter heat-sealed portion at the time of the cartridge.

Figure 7:
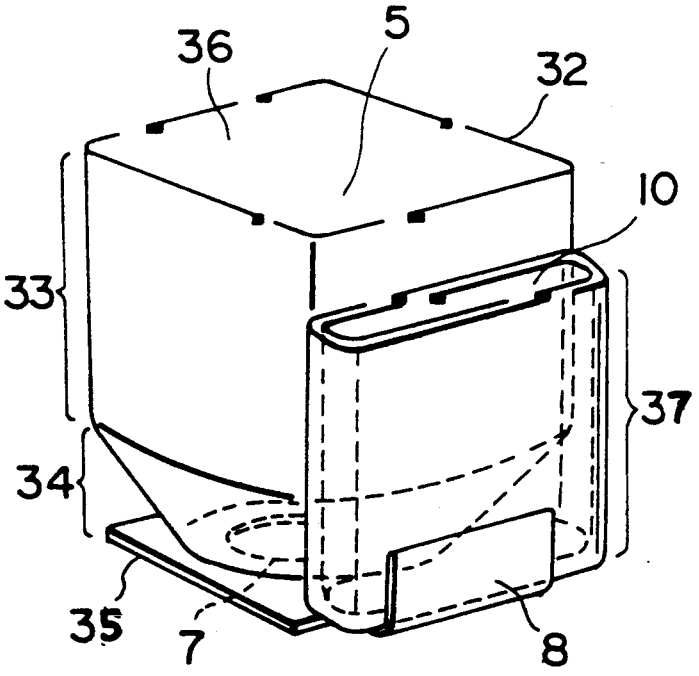
FIG. 7 is a perspective view illustrating a fifth embodiment of the toner cartridge of the present invention.

Referring to FIG. 7 illustrating another example of the vessel used in the present invention, this vessel 32 comprises a vessel side wall 33, an inclined portion 34, a receiving plate 37 and a projecting side wall 35, which are integrally formed by injection molding of a plastic material, and a first opening 7 is formed on the inner side over the connecting portion between the projecting side wall 35 and the vessel side 33. The upper and lower ends of a second zone 10 formed between the receiving wall 37 and the inclined portion 34 are opened, and a closable top plate 36 is formed on the top end of the vessel side 33 by such means as ultrasonic welding to form a first zone 5 for containing a toner therein. The receiving plate 35 provides a sealing face to the sealing member 8, and the receiving plate 35 receives a lid (not shown) for preventing dropping of the toner even if the toner is left in the interior when the cartridge is drawn out.

As is apparent from the foregoing description, according to the present invention, not only a first zone for containing a toner therein but also a second zone is formed and a first opening and a second opening are formed adjacently to each other in these zones, respectively, one end of a sealing member is located on the edge, on the side of the second opening, of the first opening while the other end of the sealing member is secured to the confronting edge of the second opening, and the sealing member is peeled in the state where the sealing member is stuffed into the second zone through the second opening. Accordingly, the sealing member, which is folded back in the first opening and is present in the double-piled state while the sealing member is sealed, is also folded back in the second zone and is present in the double-piled state while the sealing member is opened. Therefore, the stroke of attachment of the cartridge to the toner supply zone and the stroke of peeling of the sealing member are made substantially equal to the width of the first opening, and hence, the attachment size of the cartridge can be shortened and the attachment operation and the operation of peeling the sealing member can be simplified.

Furthermore, since the peeled sealing member is contained in the second zone, the cartridge which finishes replenishment of the toner can be drawn out from the toner supply zone of the developing device by a one-touch operation without touching the sealing member by hands, and even if the toner adheres to the sealing member, there can be attained an advantage in that hands of an operator and surroundings are not contaminated with the toner.

I claim:

1. A toner cartridge for attachment to a toner supply zone of a developing device to replenish toner to the developing device, which comprises a vessel for containing the toner therein, a toner supply opening formed in the vessel and a sealing member covering the toner supply opening, wherein the vessel includes a first zone filled with toner and a second zone not filled with the toner, a first opening from which the toner flows out at the time of attachment of the cartridge being formed in the first zone, a second opening adjoining directly or with a spacing from the first opening being formed in the second zone, said first opening and second opening being formed on a plane traversing a direction of attachment of the cartridge, the sealing member being arranged so that one end portion of the sealing member is located on one edge of the first opening, on the side of the second opening, a part of the sealing member being peelably sealed to the whole peripheral edge of the first opening, a remaining part of the sealing member being folded back on another edge of the first opening to stride over the first opening and second opening and the other end of the sealing member being secured to the confronting edge of the second opening, and synchronously with the attachment of the cartridge, at least a part of the sealing member being peeled being stuffed and contained in the second zone.

2. A toner cartridge as set forth in claim 1, wherein the toner supply zone of the developing device comprises a projection insertable in the second zone, and when the toner cartridge is attached to the toner supply zone, the sealing member is stuffed in the second zone in a U-figured shape by the projection to peel the sealing member from the first opening.

3. A toner cartridge as set forth in claim 1, wherein the size of the second zone in the attachment direction is from substantially equal to slightly larger than the width of the first opening.

4. A toner cartridge for attachment to a toner supply zone of a developing device to replenish toner to the developing device, which comprises a vessel for containing the toner therein, a toner supply opening formed in the vessel and a sealing member covering the toner supply opening, wherein the vessel includes a first zone filled with toner and a second zone not filled with the toner, a first opening from which the toner flows out at the time of attachment of the cartridge being formed in the first zone, a second opening adjoining directly or with a spacing from the first opening being formed in the second zone, the first opening being formed on a plane parallel to an attachment direction of the cartridge and the second opening being formed on a plane traversing the attachment direction of the cartridge, the sealing member being arranged so that one end portion of the sealing member is located on one edge of the first opening, on the side of the second opening, a part of the sealing member being peelably sealed to the whole peripheral edge of the first opening, a remaining part of the sealing member being folded back on another edge of the first opening to stride over the first opening and second opening and the other end of the sealing member being secured to the confronting edge of the second opening, and synchronously with the attachment of the cartridge, at least a part of the sealing member being peeled being stuffed and contained in the second zone.

5. A toner cartridge as set forth in claim 4, wherein the toner supply zone of the developing device comprises a projection insertable in the second zone, and when the toner cartridge is attached to the toner supply zone, the sealing member is stuffed in the second zone in a U-figured shape by the projection to peel the sealing member from the first opening.

6. A toner cartridge as set forth in claim 4, wherein the size of the second zone in the attachment direction is from substantially equal to slightly larger than the width of the first opening.

* * * * *